United States Patent [19]

Koskan et al.

[11] Patent Number: 4,530,701

[45] Date of Patent: Jul. 23, 1985

[54] PROCESS OF MANUFACTURING A CO-FUEL ADDITIVE WITH COMBUSTION-MODIFYING EFFECTS

[75] Inventors: Larry P. Koskan, Orland Park, Ill.; Roger W. Kugel, Winona, Minn.; George T. Kekish, Naperville, Ill.

[73] Assignee: Nalco Chemical Company, Oak Brook, Ill.

[21] Appl. No.: 543,818

[22] Filed: Oct. 20, 1983

Related U.S. Application Data

[63] Continuation of Ser. No. 378,756, May 17, 1982, abandoned.

[51] Int. Cl.[3] ..... C10L 1/32

[52] U.S. Cl. ..... 44/51; 252/309

[58] Field of Search ..... 44/51; 252/357, 309, 252/352

[56] References Cited

U.S. PATENT DOCUMENTS

| | | | |
|---|---|---|---|
| 2,671,758 | 5/1954 | Vinograd et al. | 44/51 |
| 3,514,273 | 5/1970 | Lee et al. | 44/51 |
| 3,540,866 | 11/1970 | Miller | 252/309 |
| 4,354,872 | 10/1982 | Kekish et al. | 252/309 |

*Primary Examiner*—Y. Harris-Smith

*Attorney, Agent, or Firm*—John S. Fosse

[57] ABSTRACT

A process of manufacturing a co-fuel additive for promoting the suspension of coal macroparticles in petroleum fuel liquid incorporates a quantity of pulverulent alkaline fluxing mineral material for modifying the solid and gaseous products that results from combustion of the mixture. Miscible petroleum liquid, a coal anti-sedimentation surfactant and sufficient water to form a water-in-oil emulsion are also included in the additive.

10 Claims, 6 Drawing Figures

SEDIMENTATION CHARACTERISTICS OF A MIXTURE
OF 30% PULVERIZED COAL
IN #6 FUEL OIL

SEDIMENTATION CHARACTERISTICS OF A MIXTURE
OF 30% PULVERIZED COAL
IN #6 FUEL OIL

SEDIMENTATION CHARACTERISTICS OF A MIXTURE OF 30% PULVERIZED COAL IN #6 FUEL OIL

SEDIMENTATION CHARACTERISTICS OF A MIXTURE OF 30% PULVERIZED COAL IN #6 FUEL OIL

SEDIMENTATION CHARACTERISTICS OF A MIXTURE
OF 30% PULVERIZED COAL
IN #6 FUEL OIL

SEDIMENTATION CHARACTERISTICS OF A MIXTURE
OF 30% PULVERIZED COAL
IN #6 FUEL OIL

PROCESS OF MANUFACTURING A CO-FUEL ADDITIVE WITH COMBUSTION-MODIFYING EFFECTS

This is a continuation of application Ser. No. 378,756 filed May 17, 1982, now abandoned.

FIELD OF THE INVENTION

This invention relates broadly to combustible mixtures of coal particles and hydrocarbon oil and more particularly to chemical additives for both stabilizing such mixtures against sedimentation and controlling sulfur and particulate emissions upon combustion.

BACKGROUND OF THE INVENTION

Mixtures of particulate coal and petroleum oil have been employed in the past as fuel for boilers, steel mill blast furnaces and the like; and much of the early development work on these mixtures involved schemes for utilizing substandard coal and fines. Modernly, the desire for more efficient use of domestic energy reserves has led to renewed efforts to optimize the utility of slurries of pulverized coal and petroleum liquids for fuel purposes.

It is well known that simple mixtures of finely crushed coal and petroleum oil ordinarily exhibit undesirable particle settling, agglomeration and compaction; and the hard sediments which ultimately result tend to resist redispersion and consequently render the mixture unusable. Continuous mechanical agitation has been practiced heretofore as a means of preventing coal sedimentation. However, sedimentation and compaction can occur, even in agitated systems, wherever quiescent regions occur, such as adjacent tank corners and near flow-control valves. Reducing the coal to micron size in order to promote suspension has likewise been proposed, but this approach has proved to be unacceptably expensive.

Various chemical additives have also been developed in the past for stabilizing a suspension of coal macroparticles in a petroleum liquid co-fuel; and many of these additives act through thixotropicity or through the creation of micelles in the fluid medium. Regardless of such chemical advances in resisting sedimentation, coal and oil mixtures continue to exhibit various commercial deficiencies, notably among them being the propensity to produce air pollution upon combustion.

SUMMARY OF THE INVENTION

The instant compositions are based on the discovery that a pulverulent alkaline fluxing mineral, such as powdered limestone, can be formulated with a coal anti-sedimentation surfactant to act as a sulfur and particulate scavenger in various coal and fuel oil mixtures upon combustion. When the stabilized mixture of pulverized coal and petroleum liquid is burned to extract its heat content, the basic fluxing mineral material promotes fusion of sulfur compounds that are present from the oil fraction, or particularly from the coal, so that the products of sulfur combustion become an ingredient of the resultant slag or clinker and do not constitute an air emission pollutant, either gaseous or particulate. Other particulate emissions are also suppressed.

Accordingly, a general object of the present invention is to provide a new and improved chemical composition for adding to mixtures of coal macroparticles and petroleum oil whereby to stabilize the suspension and advantageously modify the solid and gaseous products resulting from the combustion thereof.

This and other objects and features of the invention will become apparent from a consideration of the following descriptions.

DETAILED DESCRIPTION OF THE INVENTION

Figure 1:
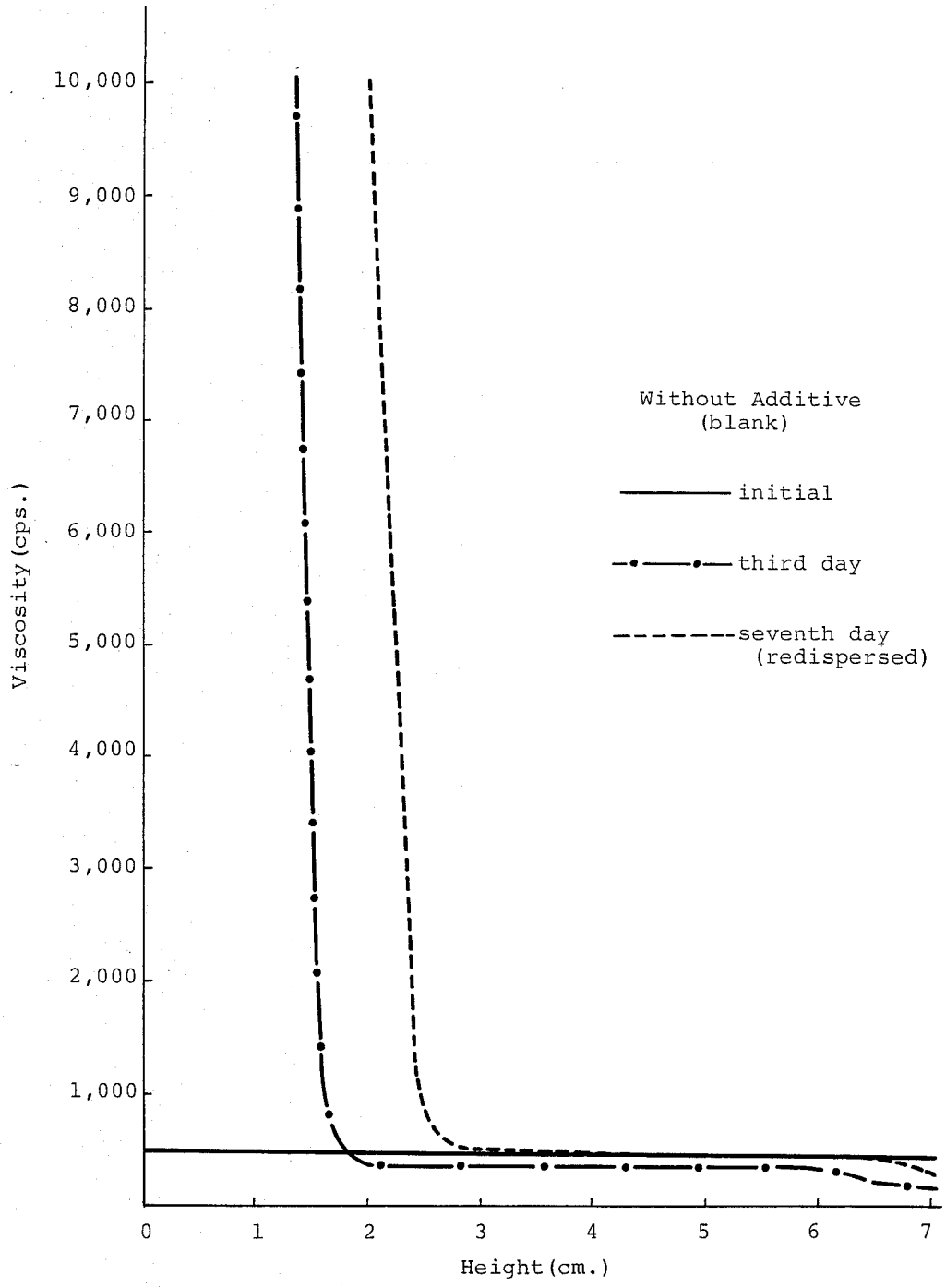
FIGS. 1–6 inclusive are charts graphically delineating data collected in the several working examples set forth hereinafter.

In compliance with the principles of the present invention, a pulverulent alkaline fluxing mineral material is usefully formulated with a miscible oil, water and a coal anti-sedimentation surfactant to form a heavy bodied water-in-oil emulsion or paste which is readily incorporated in a slurry of fuel oil and pulverized coal. The pulverulent alkaline fluxing mineral material is principally selected from the alkaline earth metal oxides and carbonates in order to promote integration of the sulfur compounds of combustion as part of the slag or clinker. The fluxing mineral material thus serves as a sulfur scavenger. It acts to trap other, finely divided solid pollutants as well.

In order that the alkaline fluxing mineral component may be readily dispersed throughout the compositions of the invention, and throughout the coal and fuel oil mixtures to which these compositions are added, the fluxing mineral material is advantageously provided as ultra-small particles, the bulk of which preferably have a mean diameter of ten microns or less. Specifically useful mineral materials for practice of the present invention include calcium carbonate, lime, magnesium oxide, magnesium carbonate, and the double carbonate of calcium and magnesium which is known as dolomite. In addition, the fluxing mineral material may include a minor proportion of a compatible mineral substance. In particular, when the alkaline fluxing mineral material is selected to be magnesium oxide, one part of alumina trihydrate is usefully incorporated with each ten parts of the magnesium oxide.

The miscible oil for use in the instant compositions is selected to be a petroleum hydrocarbon liquid that is compatible with the selected fuel oil of the coal and oil mixture; and in this connection, various lubricating oils, bright stocks and fuel oils have been employed. Particularly desirable products for incorporation in the instant compositions include Heavy Aromatic Naphtha, White Oil, and #2 Fuel Oil. The selected miscible oil serves as the enclosing emulsion phase in the compositions of the invention.

Water is advantageously included in the instant compositions in order to cooperate with the surfactant component of the present emulsified additive compositions in forming the enclosed emulsion phase which additionally contains the fluxing mineral material. In the ultimate mixture of pulverized coal and fuel oil, this water content additionally serves to flocculate the coal particles and promote a sponge-like sediment which is readily redispersed by agitation. The water content of the instant compositions is established in such a manner that it falls in the range of about 2 percent to about 8 percent by weight of the ultimate coal and oil mixture, at which levels it introduces no appreciable adverse effect on the relative thermal efficiency of the mixture.

A wide range of surfactant compounds may be employed in the instant compositions; and useful surfactants have been selected to be non-ionic or cationic materials having hydrophile/lipophile balance numbers generally in mid-range. The surfactant may be selected to act primarily as either a dispersant or a flocculant for the coal and fluxing mineral particles, as well as an emulsifier in the instant compositions; and one useful class of surfactants comprises the fatty acid alkanolamides. Alkylphenoxy polyethylene derivatives of ethanol and the modified imidazolines may also be employed. In addition, the selected surfactant acts in the mixture of pulverized coal and fuel oil to resist sedimentation of the coal particles and may be desirably formulated together with a synthetic soap or with a free fatty acid, such as stearic or oleic acid, in order to enhance the emulsification and anti-sedimentation properties.

To prepare the compositions of the invention, the selected surfactant is first added to a warmed quantity of the miscible oil under mild agitation. Thereafter, the water and fluxing mineral material are added with continued stirring.

The instant compositions are beneficially added to fuel mixtures of a petroleum oil and pulverized coal in which the coal fraction is advantageously selected, for example, to be a low-ash bituminous coal that has been pulverized so that about 75 percent or more passes a #200 sieve. While relatively higher percentages of coal in the ultimate composition are known to be associated with lower sedimentation rates, i.e. with more stable mixtures, it is also known that slurries comprising about equal parts of pulverized coal and fuel oil approach the practical optimum.

In order to enhance the understanding of the invention, the following specific formulations of the instant compositions are set forth:

| COMPOSITION A | Parts By Weight |
|---|---|
| magnesium oxide | 45.45 |
| $Al_2O_3.3H_2O$ | 4.55 |
| Witcamide 5138 (alkanolamide surfactant) | 2.0 |
| oleic acid | 5.5 |
| Stepanol DEA (lauryl sulfate diethanolamine soap) | 0.2 |
| Heavy Aromatic Naphtha | 42.3 |
| water | 66.67 |
| total | 166.67 parts |

| COMPOSITION B | Parts By Weight |
|---|---|
| calcium carbonate | 91.18 |
| Surco W/O (fatty acid alkanolamide surfactant) | 4.41 |
| #2 Fuel Oil | 4.41 |
| water | 66.67 |
| total | 166.67 parts |

In order to describe the invention more fully, the following working examples are given without, however, intending to limit the invention to the precise details and conditions set forth.

EXAMPLES 1 THROUGH 6

In each of the following examples, the selected surfactant was first added with stirring to #6 Fuel Oil that had been pre-warmed to about 60° C. The remaining ingredients were then added together, and stirring was continued for 30 minutes. Pulverized bituminous coal was selected for these tests; and the particular coal product which was employed possessed the following analysis:

| PULVERIZED BITUMINOUS COAL ANALYSIS | |
|---|---|
| Appearance | Brown Powder |
| Percent Moisture Loss at 105° C. | 3.0 |
| Percent Sulfur | 1.7 |
| Percent Ash, Moisture Free Basis | 4.9 |
| Carbon (% C) | 61.5 |
| Hydrogen (% H) | 4.5 |
| Nitrogen (% N) | 1.1 |
| % Volatile Matter | 37.7 |
| Heating Value (BTU/lb) | 13,690 |

| Ash Components: | | Percent of Ash by weight |
|---|---|---|
| Silicon | as $SiO_2$ | 39 |
| Aluminum | as $Al_2O_3$ | 30 |
| Iron | as $Fe_2O_3$ | 20 |
| Calcium | as CaO | 4 |
| Sulfur | as $SO_3$ | 3 |
| Potassium | as $K_2O$ | 2 |
| Titanium | as $TiO_2$ | 1 |
| Phosphorus | as $P_2O_5$ | 1 |
| Magnesium | as MgO | 1 |

Sieve Analysis of Pulverized Coal:

| Retained on Sieve | Passing Sieve | Percent By Weight |
|---|---|---|
| 600 μm (No. 30) | — | 0.00 |
| 300 μm (No. 50) | 600 μm (No. 30) | 0.00 |
| 150 μm (No. 100) | 300 μm (No. 50) | 0.72 |
| 75 μm (No. 200) | 150 μm (No. 100) | 11.84 |
| 45 μm (No. 325) | 75 μm (No. 200) | 17.51 |
| — | 45 μm (No. 325) | 68.95 |

A suitable number of prepared 350-gram samples were stored in individual one-pint, wide-mouth glass jars at a constant temperature of 60° C. plus or minus 0.5° C.; and viscosities were measured as a function of height in the jar at convenient time intervals by means of a Brookfield viscometer with a helipath attachment. The helipath attachment acted to raise or lower the entire Brookfield viscometer at a constant rate. The spindles used were wire tees with crosspieces of various lengths. These spindles traced out helical patterns through fresh, unsheared volumes of sample. This arrangement permitted admirable determination of stability since sedimentation levels and viscosities were measured simultaneously.

Six variables were explored, and the respective sets of data are graphically portrayed in FIGS. 1–6 inclusive of the drawings.

Figure 2:
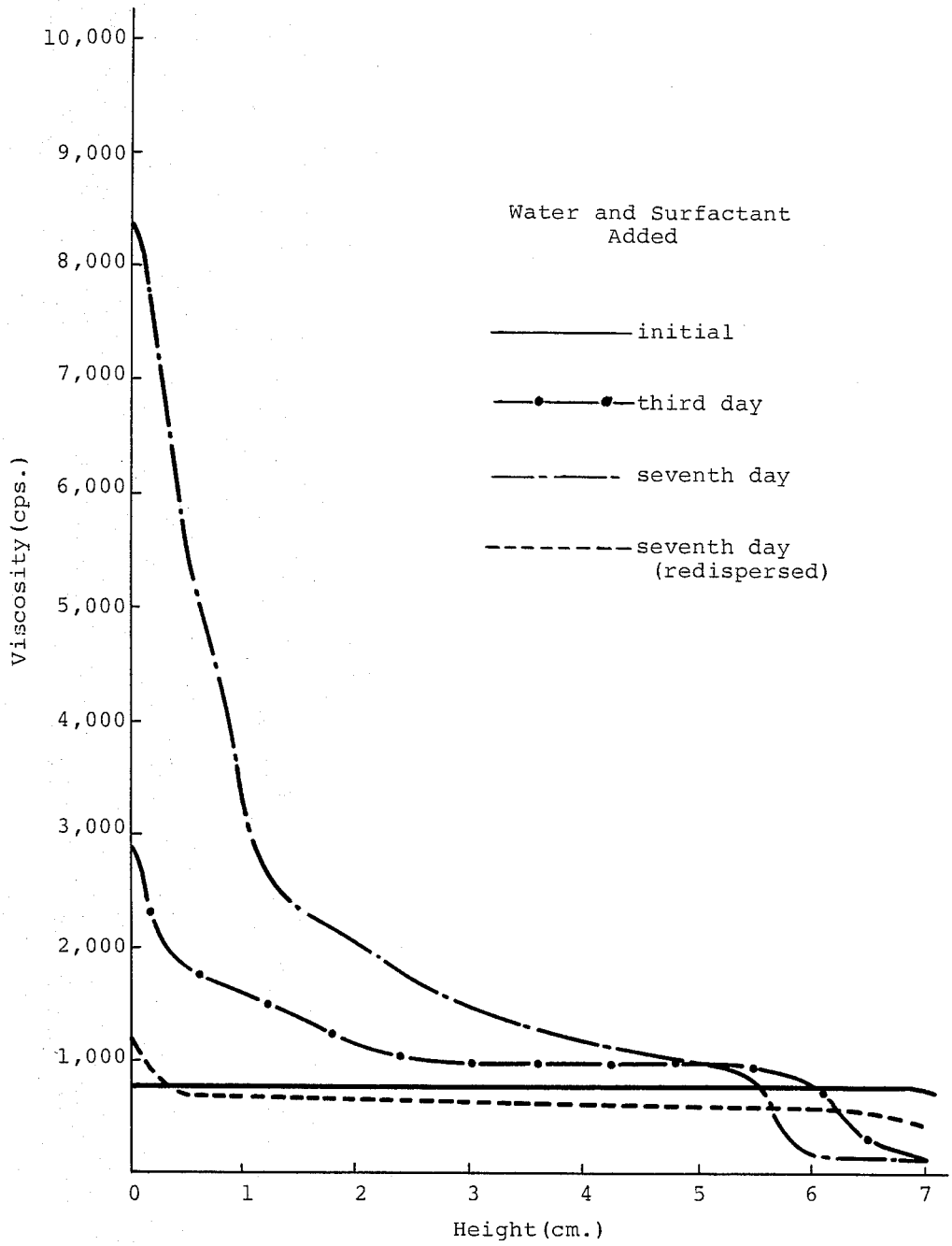

The data in FIG. 1 was collected for a "blank" sample in which no water or other additive was incorporated; and the data set forth in FIG. 2 is for a coal and fuel oil mixture incorporating Composition B but omitting the fluxing mineral material, the specific additions being 2% water and 0.3% surfactant by weight. Comparing the data for FIG. 1 with that for FIG. 2 points out that the inclusion of water and the selected surfactant achieved a pronounced improvement in the sedimentation characteristics. Moreover, the sediment in the coal and oil mixture was readily redispersed after one week's storage when the water and surfactant additive was included.

Figure 3:
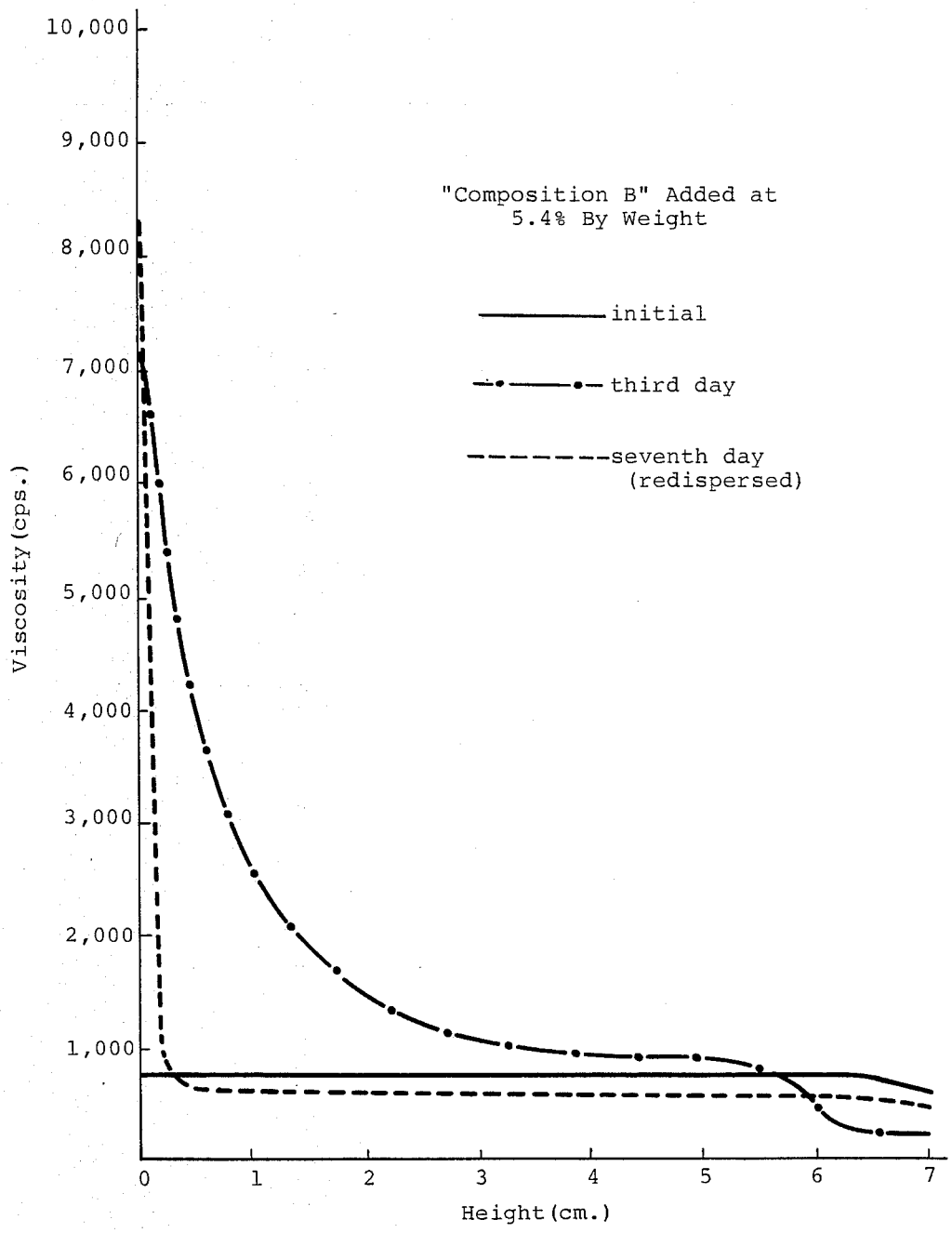
Figure 4:
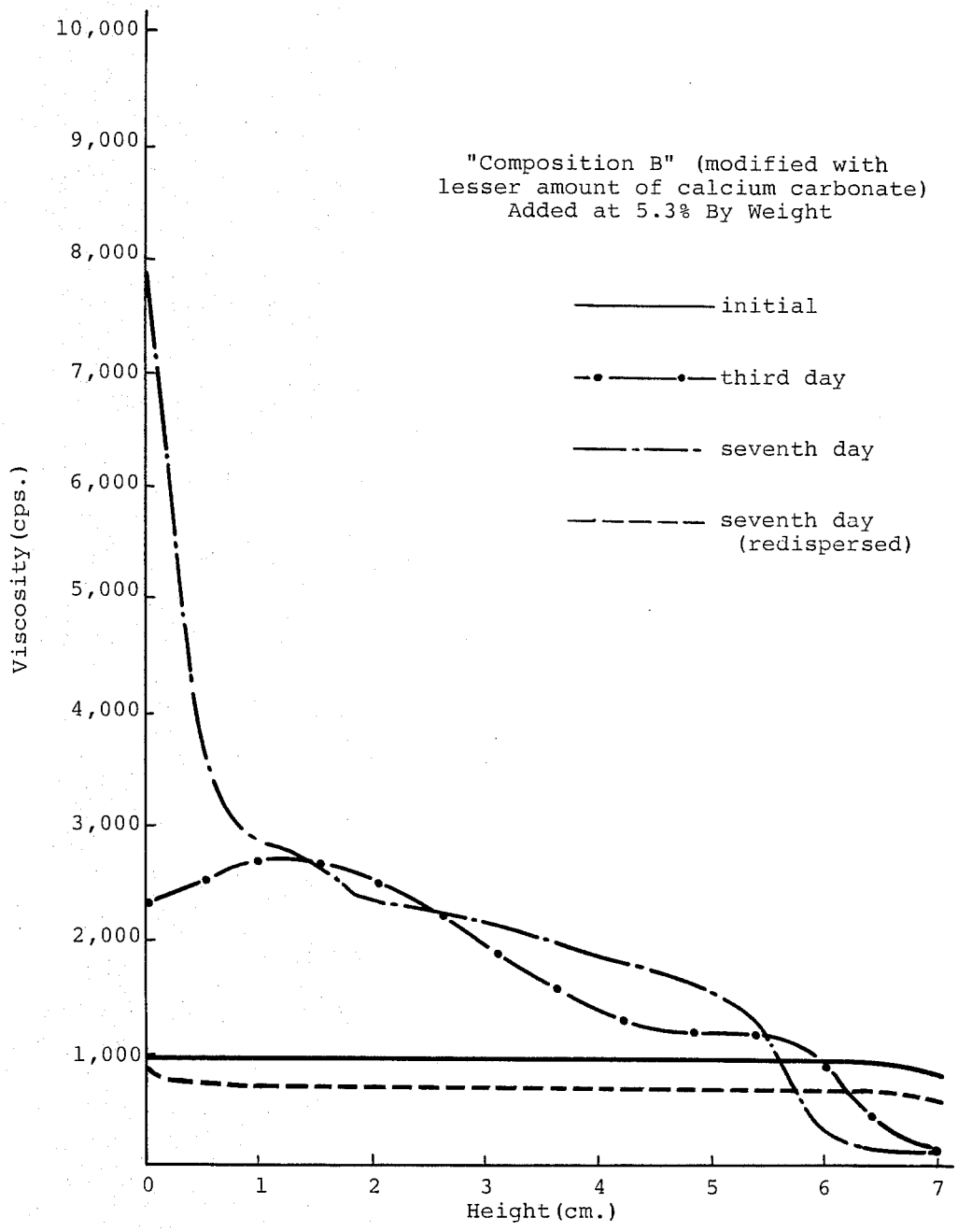

The data in FIG. 3 represents the coal and oil mixture to which Composition B was added at a level of about 5.4% by weight. The data in FIG. 4 is for the same mixture but with a slightly lesser content of calcium carbonate. Comparing the data in FIGS. 3 and 4 with that in FIG. 2 shows that the addition of the fluxing mineral material produced only a slight detrimental effect on the sedimentation characteristics.

Figure 5:
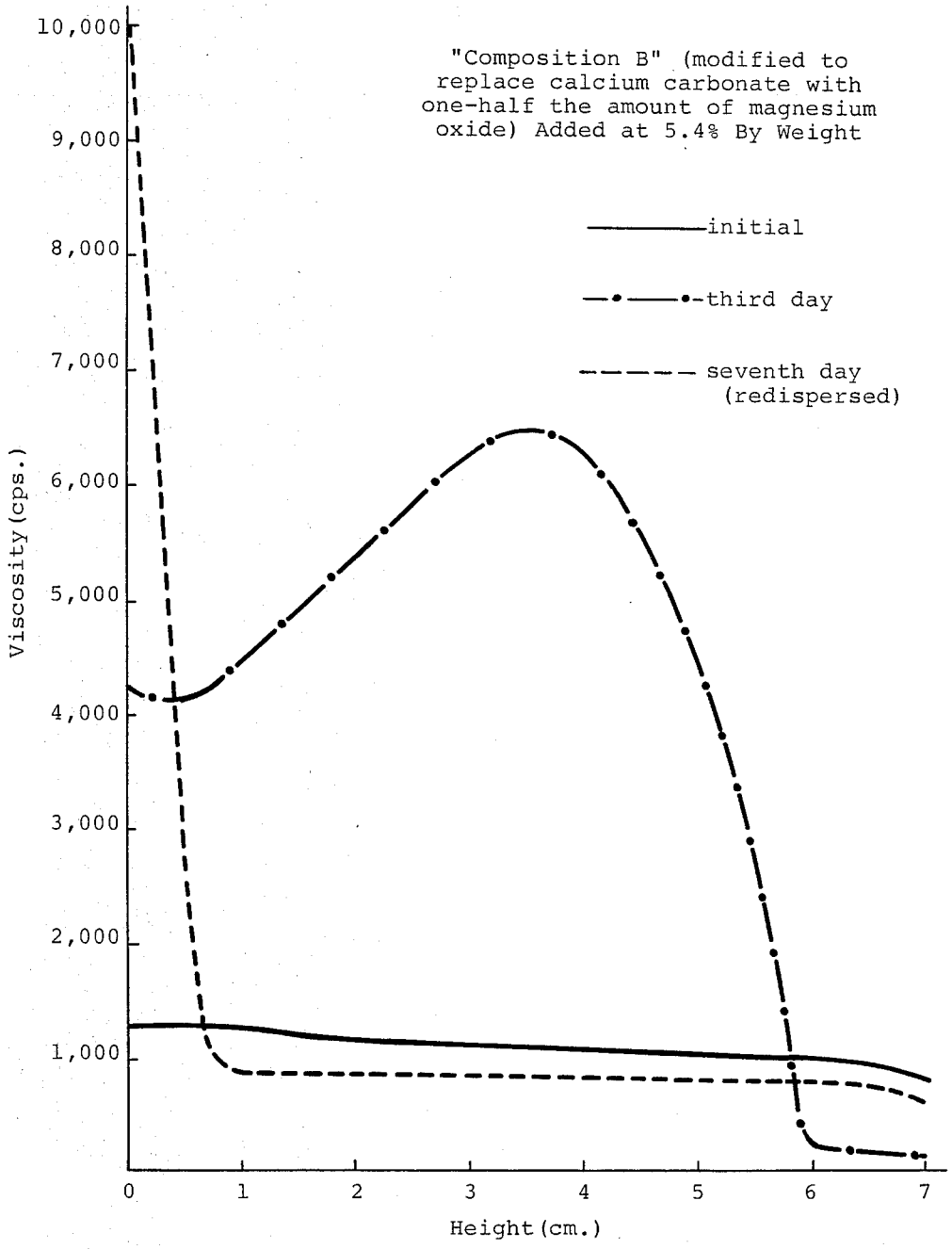
Figure 6:
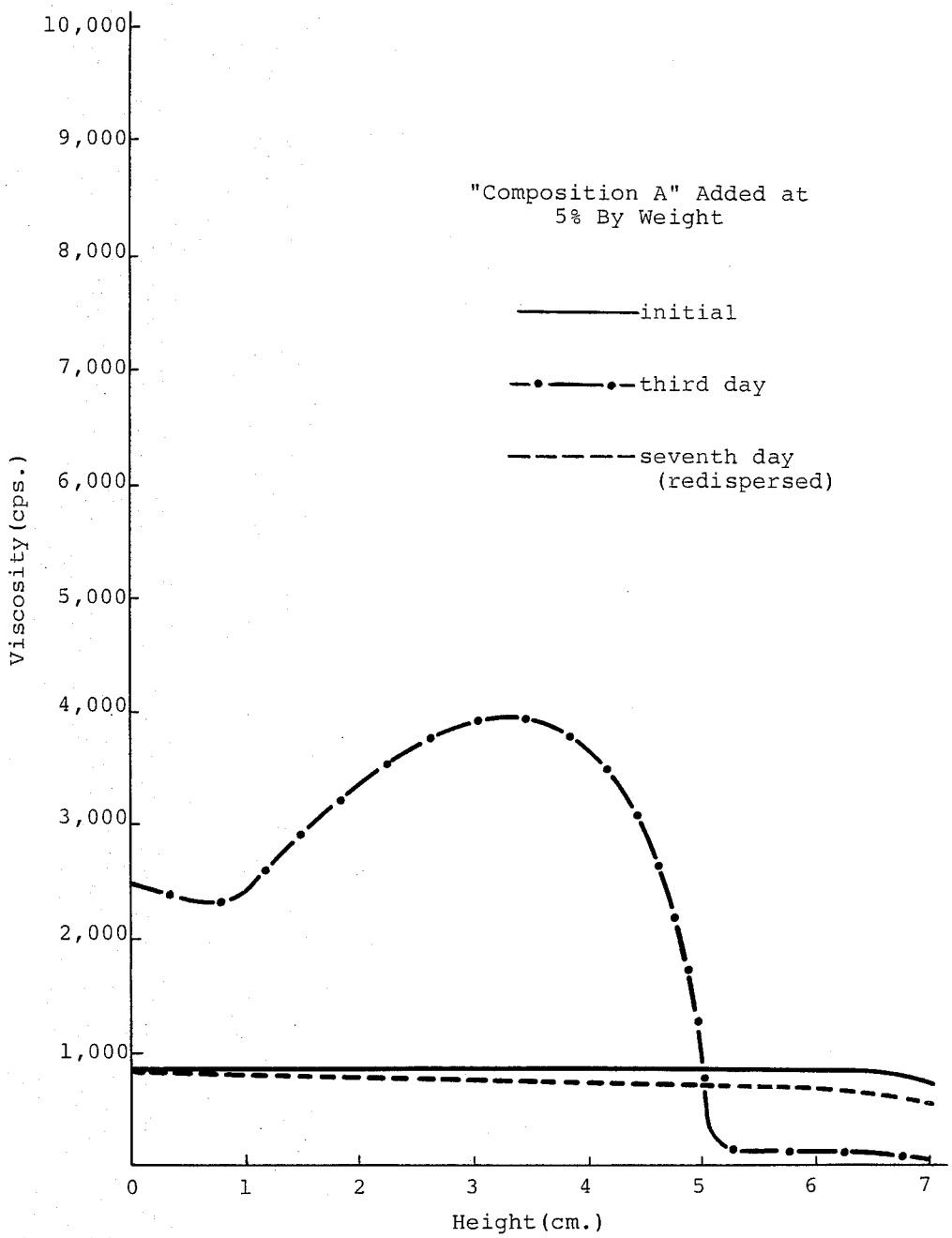

The data in FIG. 5 is for the coal and fuel oil mixture to which had been added the formulation of Composition B at a rate of about 5.4% by weight and wherein the calcium carbonate content had been replaced with approximately one-half the amount by weight of magnesium oxide. A comparison of the data in FIGS. 2 and 5 indicates that a moderately adverse effect on sedimentation was attributable to the presence of the magnesium oxide; and comparison with the data for FIG. 4 reveals that the addition of magnesium oxide had a slightly more adverse effect than calcium carbonate as a component in the additive composition. However, the data in FIG. 6 is for the coal and fuel oil mixture to which has been added approximately 5 percent by weight of Composition A. The data in FIG. 6 shows that the reformulation of the magnesium oxide and surfactant achieved a product with useful anti-sedimentation properties, especially with respect to redispersability.

The specific examples herein shown and described are to be considered as being primarily illustrative. Various changes beyond those described will, no doubt, occur to those skilled in the art; and such modifications are to be understood as forming a part of this invention insofar as they fall with the spirit and scope of the appended claims.

The invention is claimed as follows:

1. The process of manufacturing a co-fuel composition wherein the suspension of coal macroparticles in a petroleum fuel liquid is promoted during transportation and storage and wherein the solid and gaseous products resulting from the combustion of the co-fuel are modified, said process comprising the steps of: providing a composition of petroleum fuel oil and powdered coal; mixing a coal anti-sedimentation surfactant with a petroleum liquid that is miscible with said petroleum fuel oil and thereafter incorporating in said surfactant mixture a quantity of pulverulent alkaline fluxing mineral material and a quantity of water which is sufficient to form a water-in-oil emulsion with said petroleum liquid and which is sufficient to take up said fluxing mineral material into the enclosed, water phase of said emulsion; and adding said surfactant/mineral mixture to said composition of oil and coal.

2. The process according to claim 1 wherein said alkaline fluxing mineral material includes calcium carbonate.

3. The process according to claim 1 wherein said alkaline fluxing mineral material includes calcium oxide.

4. The process according to claim 1 wherein said alkaline fluxing mineral material includes magnesium oxide.

5. The process according to claim 1 wherein said alkaline fluxing mineral material includes the double carbonate of calcium and magnesium.

6. The process according to claim 1 wherein said alkaline fluxing mineral material includes magnesium carbonate.

7. The process according to claim 1 wherein said alkaline fluxing mineral material includes a mixture of ten parts of magnesium oxide and one part of alumina trihydrate.

8. The process according to claim 1 wherein said coal anti-sedimentation surfactant includes a fatty acid alkanolamide.

9. The process according to claim 1 wherein said petroleum liquid is #2 Fuel Oil.

10. The process according to claim 1 wherein said petroleum liquid is Heavy Aromatic Naptha.

* * * * *